US005528276A

United States Patent [19]

Katsuma

[11] Patent Number: 5,528,276

[45] Date of Patent: Jun. 18, 1996

[54] METHOD AND DEVICE FOR EQUALIZING RESISTANCE OF HEATING ELEMENT OF THERMAL HEAD OF THERMAL PRINTER

[75] Inventor: Nobuo Katsuma, Saitama, Japan

[73] Assignee: Fuji Photo Film Co., Ltd., Kanagawa, Japan

[21] Appl. No.: 214,755

[22] Filed: Mar. 18, 1994

[30] Foreign Application Priority Data

Mar. 18, 1993 [JP] Japan ..... 5-058649

[51] Int. Cl.[6] ..... B41J 2/35

[52] U.S. Cl. ..... 347/191; 324/678

[58] Field of Search ..... 347/190, 191, 347/19, 200, 209, 211; 29/610, 611, 612; 324/678

[56] References Cited

U.S. PATENT DOCUMENTS 4,782,202 11/1988 Sawae et al. ..... 347/191

FOREIGN PATENT DOCUMENTS 61-213169 9/1986 Japan .

773 11/1986 Japan ..... 347/191

2-248262 10/1990 Japan .

2-292060 12/1990 Japan .

OTHER PUBLICATIONS

Constantin, et al., Proceedings of the 1982 International Microelectronics Conference —Effect of Surge Voltage on Thin & Thick Film Resistors.

*Primary Examiner*—Benjamin R. Fuller
*Assistant Examiner*—L. Anderson

[57] ABSTRACT

When setting up the thermal head, respective resistances of the heating elements of the thermal head are measured, and a difference between the resistance value of each heating element and the smallest resistance value is detected. A predetermined amount of resistance trimming energy for lowering the resistance of the heating element by a predetermined constant amount is applied to each heating element for a number of times which depends on the detected difference in the resistance of the heating element from the smallest resistance, to trim the resistance of the heating element down to the smallest resistance.

15 Claims, 5 Drawing Sheets

METHOD AND DEVICE FOR EQUALIZING RESISTANCE OF HEATING ELEMENT OF THERMAL HEAD OF THERMAL PRINTER

BACKGROUND OF THE INVENTION

1. Field of the Invention

The present invention relates to a method of equalizing resistances of heating elements of a thermal head of a thermal printer. The present invention also relates to a device for a thermal printer which equalizes resistances of heating elements of a thermal head. The present invention relates more particularly to a device and a method for equalizing resistances of the heating elements by using a resistance trimming process wherein the heating elements are preliminary heated by trimming energy.

2. Related Art

A thermosensitive color recording material has been suggested, for example, in Japanese Laid-open Patent Application 61-213169, which has those thermosensitive coloring layers for yellow, magenta and cyan which are laminated or formed on a supporting material in this order from the outside. In this type of recording material, the heat sensitivities of the thermosensitive coloring layers (hereinafter referred to as coloring layers) become lower with the distance from the outside surface. Furthermore, the coloring layers have properties that each coloring layer is optically fixed by electromagnetic rays of a respective specific wave length range. Therefore, recording of a full-color image on the above-described thermosensitive color recording material is performed in the order from the top or outermost coloring layer to the inner coloring layer, while optically fixing the just recorded coloring layer prior to recording the next coloring layer, so as to avoid undesirable double recording.

The thermal printer includes a thermal head having a plurality of heating elements which are connected in parallel to one another and arranged in an array. The thermal head gives a variable amount of heat energy to the color thermosensitive recording layer depending on the sensitivity of the color recording layer to be color developed. Specifically, a bias heat energy is first applied for heating the thermosensitive color recording material up to such a temperature above which a predetermined color begins to be developed in the corresponding color recording layers, the amount of bias heat energy is constant and determined according to the sensitivity of each color recording layer. Next, a variable amount of gradation heat energy necessary for developing the color at a desirable density is applied.

To reproduce a fine gradation, it is necessary to accurately control the amount of gradation heat energy. In general, the heating elements are activated or power is conducted for about several milliseconds or several tens of milliseconds for the bias heating. On the other hand, the conduction time of the heating elements is controlled at an accuracy of several micro seconds or several tens of micro seconds.

In spite of such a fine control of heating or conduction time of the heating elements, the consequent image cannot exactly reproduce the desired fine gradation unless all the heating elements of the same thermal head have a completely uniform resistance value. However, it is generally assumed that the heating elements have a variation of about 5% in resistance. For this reason, the printed images tend to have troubles, such as chromatic unevenness, due to the unevenness of the thermal elements.

To avoid such troubles, a thermal printer has been known, for example, from Japanese Laid-open Patent Application No. 2- 248262, wherein resistance values of all the hundreds of heating elements of the thermal head are measured, and correction data is calculated based on the results of measurement, so as to correct image data by the correction data. Another thermal printer as disclosed in Japanese Laid-open Patent Application No. 2-292060 interpolates density correction pulses between gradation pulses so as to compensate for the chromatic unevenness caused by the unevenness in resistances of the heating elements.

However, in order to interpolate the density correction pulses, an additional pulse generation circuit for generating the correction pulses is necessary, which increases the cost of the thermal printer. Moreover, interpolation of the density correction pulses increases the printing time a, compared with the case where no correction pulse is interpolated.

Because an enormous operation is necessary for directly correcting the image data by the correction data, the former method needs a high speed calculating circuit so that the cost of the thermal printer also increases. Besides that, because the operation of the image data amplifies quantizing distortion, printed images contain pseudo outlines thereby lowering the quality of printed image.

SUMMARY OF THE INVENTION

In view of the foregoing, an object of the invention is to provide a method of equalizing resistances of heating elements of a thermal head, and a device for the method, which eliminates chromatic unevenness caused by resistance difference between the heating element.

To achieve the above and other objects, in a method of the present invention, respective resistances of the heating elements of the thermal head are measured, and a difference between the resistance of one heating element and the smallest one of these resistances is detected. Thereafter, a variable amount of resistance trimming energy is applied to the heating element in accordance with the difference so as to lower the resistance of the heating element down to the smallest resistance. For example, the trimming energy is supplied to the heating element by applying a variable voltage for a constant time, wherein the variable voltage is variable according to the difference but is higher than a print voltage for driving the heating element in printing. Alternately the trimming energy is obtained by continuously or intermittently applying a constant voltage for a variable time, wherein the constant voltage is higher than the print voltage.

According to the method of the present invention, the resistance of the heating elements are equalized by applying the resistance trimming energy during an initial setup of the thermal head. Because the heating elements are individually heated during the initial setup of the thermal head, by an amount which is determined for each heating element to make the respective resistances of the heating elements approximately equal to the smallest one of all these resistances, the unevenness of the resistance of the heating elements is eliminated. Therefore, conventional image density correction compensating for the resistance unevenness is unnecessary. Therefore, no complicated and expensive calculating circuit nor such density correction pulses that elongate the printing time is necessary.

The reason why unevenness in resistance is dissolved by the above resistance trimming process is as follows:

The resistance unevenness of the heating elements is mainly caused by unevenness of crystals or compositions of the heating elements. But the composition of a the resistance layer is equalized by applying heat energy of certain amount, so that the resistance unevenness is reduced.

According to a preferred embodiment of the present invention, a resistance reduction value is experimentally predetermined based on the above-described resistance reduction amounts, for gradually or stepwise reducing the resistance of each heating element to the smallest resistance. A unit trimming voltage, a unit trimming current and a unit trimming time for reducing resistance of the heating elements by one grade, that is, by the predetermined resistance reduction value, are calculated and stored as the unit trimming data. The difference from the smallest resistance is divided by the predetermined resistance reduction value so as to determine how many times the resistance trimming operation should be repeated for each heating element. Thereby, fine trimming of the resistances is achieved.

BRIEF DESCRIPTION OF THE DRAWINGS

The above and other objects and advantages of the invention will become apparent from the following detailed description of the preferred embodiments when read in conjunction with the accompanying drawings which are given by way of illustration only and thus are not limitative of the present invention, and wherein.

DETAILED DESCRIPTION OF THE PREFERRED EMBODIMENTS

Figure 1:
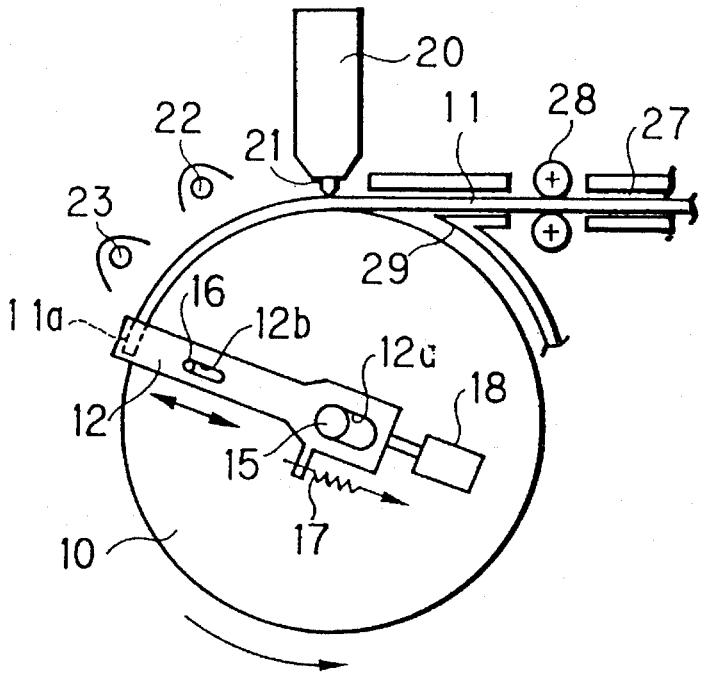
FIG. 1 is a schematic view of a direct color thermal printer having a thermal head whose resistance is equalized by a resistance trimming process according to an embodiment of the present invention.

In FIG. 1, a platen drum 10 carries a thermosensitive color recording paper 11 on the outer periphery thereof, and is rotated by a pulse motor (not shown) in a direction of an arrow during thermal recording. The platen drum 10 is provided with a clamp member 12 which secures the thermosensitive color recording paper 11 to the platen drum 10 at least at a portion, for example, at the leading end 11*a* of the thermosensitive color recording paper 11. The clamp member 12 is of a channel shape having a clamp portion extending in an axial direction of the platen drum 10 and arm portions extending in a radial direction of the platen drum 10. Slots 12*a* and 12*b* are formed in either arm portion. The slot 12*a* is engaged with both ends of a platen drum shaft 15, and the slot 12*b* is engaged with guide pins 16 provided on both sides of the platen drum 10. The clamp portion of the clamp member 12 is ordinarily pressed onto the platen drum 10 by a spring 17, and is removed off the platen drum 10 by an act of a solenoid 18 when the thermosensitive color recording paper 11 is to be placed on or displaced from the platen drum 10.

Above the outer periphery of the platen drum 10, a thermal head 20 having an array of heating elements 21, and optical fixing devices 22 and 23 are disposed. The heating elements 21 sequentially radiate constant bias heat energy and variable heat energy for reproducing gradation depending on the recording density of each pixel.

The thermosensitive color recording paper 11 is fed to the platen drum 10 through a paper passageway 27 by means of a pair of feed rollers 28. After printing, the thermosensitive color recording paper 11 is ejected from the platen drum 10 through the paper passageway 27. In the vicinity of the paper passageway 27, on the side near to the platen drum 10, a peeling member 29 is provided for peeling off the trailing end of the thermosensitive color recording paper 11 from the platen drum 10 and guiding the thermosensitive color recording paper 11 to the paper passageway 27 when ejecting the thermosensitive color recording paper 11. Although the paper passageway 27 is commonly used for paper feeding and ejecting, it is possible to provide a paper ejection path separately from a paper feed path.

Figure 2:
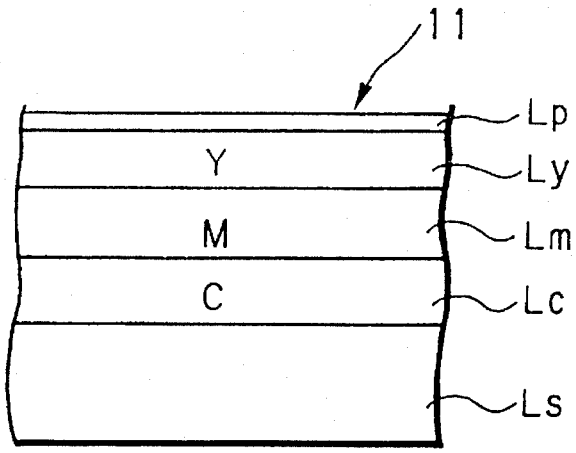
FIG. 2 is an explanatory view of the construction of a thermosensitive color recording material.

FIG. 2 shows an example of the thermosensitive color recording paper 11, wherein a cyan recording layer Lc, a magenta recording layer Lm and a yellow recording layer Ly are formed on a supporting material Ls in this order from the inside. The supporting material Ls is an opaque coated paper or plastic film. However, when an OHP (over-head projector) sheet is designed to be made, a transparent plastic film is used as the supporting material. A protection layer Lp is formed on the yellow recording layer Ly.

The cyan recording layer Lc contains an electron donating dye precursor and an electron accepting compound as main components, and is colored in cyan when a predetermined amount of heat energy per unit area is applied thereto. The magenta recording layer Lm contains a diazonium salt compound having a maximum absorption factor at a wave length of about 360 nm and a coupler which acts upon the diazonium salt compound and is developed in magenta when coupler is heated. The magenta recording layer Lm loses its capacity of color-developing when the magenta recording layer Lm is exposed to electromagnetic or ultraviolet rays of about 360 nm, because the diazonium salt compound is photochemically decomposed by this range of rays. The yellow recording layer Ly contains a second diazonium salt compound having a maximum absorption factor at a wave length of about 420 nm and a coupler which acts upon the second diazonium salt compound and is colored in yellow when the coupler is heated. The yellow recording layer Ly also loses its color developability when the yellow recording layer Ly is exposed to electromagnetic or near ultraviolet rays of about 420 nm.

In correspondence with the above properties of the thermosensitive color recording paper 11, the optical fixing device 22 has an emission center at wave length of 365 nm for fixing the magenta recording layer Lm, whereas the optical fixing device 23 has an emission center at wave length of 420 nm for fixing the yellow recording layer Ly. It is to be noted that it is possible to provide a single ultraviolet lamp in combination with a sharp-cut filter so as to radiate the electromagnetic rays of about 365 nm and about 420 nm.

Figure 3:
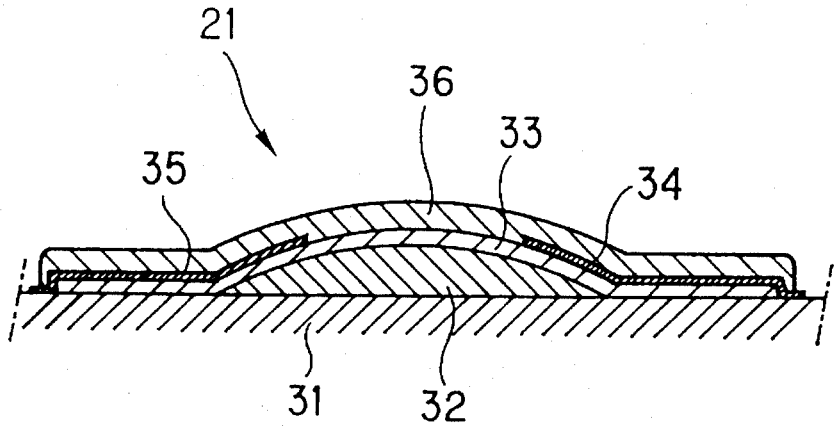
FIG. 3 is a sectional view of the heating element of the thermal head.

FIG. 3 shows a sectional view of an example of the heating element 21. Each heating element 21 is constituted of a ceramic substrate 31, a partial grazed glass layer 32 and a resistance layer 33 which are laminated or formed on the ceramic substrate 31 in this order from the bottom. A pair of electrodes 34 and 35 are connected to the resistance layer 33, and a protection layer 36 covers and protects the elements 32, 33, 34 and 35 from ambience. If the resistance layer 33 is not sufficiently and uniformly crystallized, an unevenness in the resistance of the heating element 21 results. However, it is known in the art that the composition of the resistance layer 33 is equalized and thus the resistance unevenness is reduced when the heating element 21 is heated by conducting a certain amount of electric energy. Since the condition of connection between the resistance layer 33 and the electrodes 34 and 35 is also equalized by applying the certain amount of heating energy, the resistance unevenness which may be caused by the unevenness of the connecting condition is also reduced.

Figure 4:
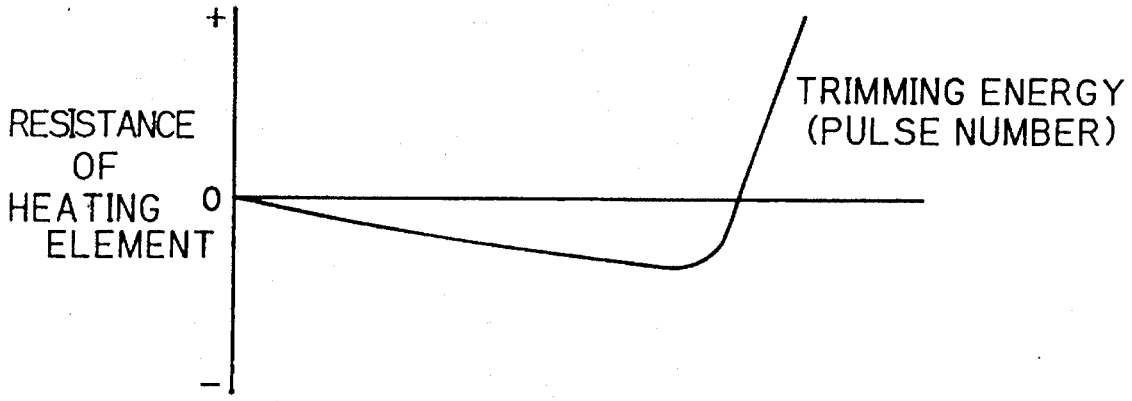
FIG. 4 is a graph illustrating the resistance trimming effect in the heating element.

FIG. 4 illustrates an example of relationship between the resistance of the heating element 21 and trimming energy or heating energy which is applied to the heating element 21 in the form of drive pulses. As shown in FIG. 4, the resistance of the heating element 21 gradually decreases as the trimming energy increases, and then rapidly increases after the trimming energy goes beyond a certain amount.

Therefore, according to a preferred embodiment of the present invention, the resistances of the heating elements 21 are equalized by applying an amount of trimming or heating energy to each individual heating element, so as to trim or reduce the resistance of the heating elements to the smallest value of all the resistances of the heating elements which are measured during an initial setup for the thermal head 20.

The trimming energy is preferably applied in sharing a fashion, that is, in the form of voltage pulses, thereby to gradually reduce the resistance of the heating element 21. Hereinafter, a voltage value, a current value, and a time period for generating a constant amount of trimming energy are referred to as a unit trimming voltage $E_{TRIM}$, a unit trimming current $I_{TRIM}$, and a unit trimming time $T_{TRIM}$, respectively, and a constant resistance reduction amount obtained by applying the constant amount of trimming energy is referred to as a unit resistance reduction $\Delta R_{TRIM}$.

These unit trimming data $E_{TRIM}$, $I_{TRIM}$, $T_{TRIM}$, and $\Delta R_{TRIM}$ are experimentally predetermined and memorized in the thermal printer. Specifically, the unit trimming data is predetermined based on a resistance reduction amount of the heating elements which is detected by applying a trimming or heating energy defined by a voltage, e.g. 30V, a current, e.g. 12.5 mA, and a time, e.g. 5 ms, to the heating elements, assuming the resistance of each heating element is 2400 Ω.

Figure 5:
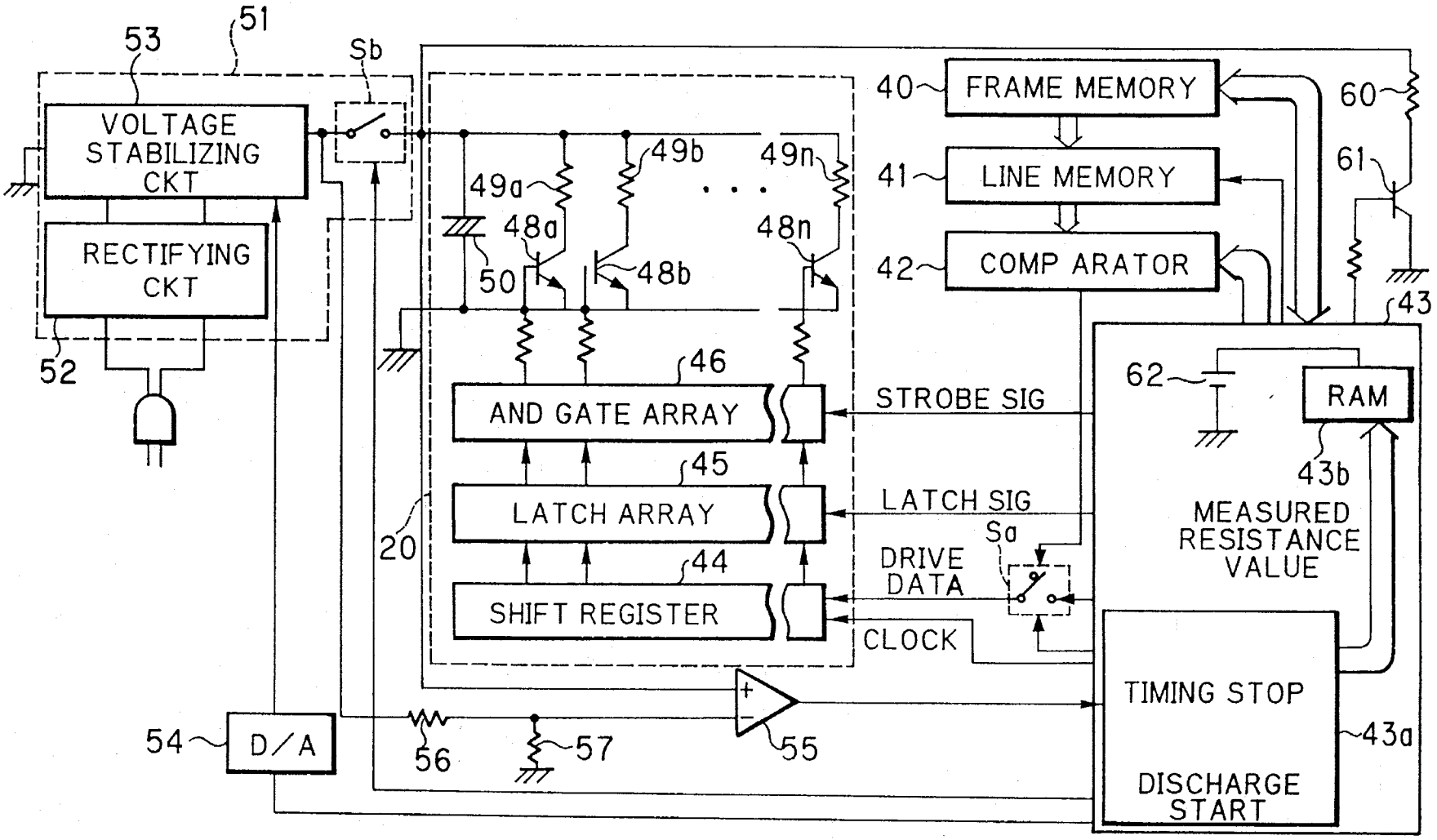
FIG. 5 is a block diagram showing the circuitry of the direct color thermal printer having a resistance equalizing device for the thermal head, according to an embodiment of the present invention.

FIG. 5 shows the circuitry of a direct color thermal printer embodying the present invention. Color image data is inputted through an image input device (not shown) such as a color scanner, a color television camera or the like, and subjected to three primary color separation, color and density correction, and other processing. The processed image data of one frame is stored in a frame memory 40 separately for each color. In thermal recording, the image data are read out for each color and line by line from the frame memory 40, and are written in a line memory 41. The image data of one line is read out from the line memory 41, and is serially sent to a comparator 42. The comparator 42 compares the image data with gradation data as reference data for predetermined tonal steps, and outputs a high level signal "H" when the image data of that pixel is larger than the compared gradation data.

The gradation data is serially generated by a microcomputer 43 in the order from the lowest tonal step, for example, 64 gradation data "0" to "3F" in the hexadecimal notation are generated if the gradation is constituted of 64 tonal steps. The comparator 42 compares the image data for each pixel of one line with the respective gradation data "0" to "3F". After the image data of each pixel of one line is compared with the first gradation data "0", the results of the comparison are outputted from the comparator 42 in the form of a serial signal, and the microcomputer 43 generates and supplies the second gradation data "1" to the comparator 42. The serial signal is sent to a shift register 44 of the thermal head 20 through a first switch Sa, which is used to switch the thermal printer between a print mode and a resistance measuring mode. In this way, the image data of each pixel is compared 64 times so as to be converted into 64-bit drive data for each pixel. In other words, the 64-bit drive data is sent to the shift register 44 by transferring the serial signals 64 times from the comparator 42 to the shift register 44.

The serial drive data is shifted in the shift register 44 at the timing of a clock signal, so as to be converted into a parallel form. The parallel drive data is latched in a latch array 45 in synchronism with a latch signal. The latch array 45 includes a number of elements corresponding to the number "n" of the pixels consisting of one line (n=an integer). The parallel outputs of the latch array 45 are connected to an AND gate array 46 including the corresponding number "n" of AND gates. The AND gate array 46 receives a strobe signal. If the one bit of the 64-bit drive data that is just applied to a first input of one AND gate is high when the strobe signal is applied to a second input of that AND gate, the AND gate outputs a high level signal "H".

The parallel outputs of the AND gate array 46 are connected to transistors **48*a* to 48*n* in one to one relation, and each of the transistors 48*a* to 48*n* is turned ON when the allocated output of the AND gate array 46 takes the high level "H". The transistors 48*a* to 48*n* are connected in series to the plurality of resistors 49*a* to 49*n* constituting the heating elements 21 of the thermal head 20** in one to one relation.

A capacitor 50 is connected in parallel to the resistors **49*a* to 49*n*, which is used for the resistance measurement and the noise absorption. A power supply section 51 is connected to the resistors 49*a* to 49*n* through this capacitor 50. The power supply section 51 is constituted of a second switch Sb, a regulating circuit 52 and a voltage stabilizing circuit 53. A digital-to-analog (D/A) converter 54 is connected to the voltage stabilizing circuit 53. The D/A converter 54 converts a voltage change signal, which is generated by the microcomputer 43, into analog fashion, and applies the analog voltage change signal to the voltage stabilizing circuit 53. In response to the voltage change signal, the voltage stabilizing circuit 53 changes over the supply voltage to the thermal head 20 between a drive voltage value for printing and a voltage value for the resistance trimming. The output voltage from the voltage stabilizing circuit 53 is applied to each heating elements 21 through a second switch Sb which is controlled by the microcomputer 43. The second switch Sb is maintained closed or in an ON position, during the printing and during the resistance trimming. In the resistance measuring mode, the second switch Sb is turned OFF and ON each time the resistance values Ra to Rn of the resistors 49*a* to 49*n*** are measured.

A first terminal of the capacitor 50 is connected to a non-inverted input of a comparator 55. Therefore, the voltage level at the non-inverted input of the comparator 55 is equal to the charge voltage $V_H$ of the capacitor 50. A reference voltage Vref of the comparator 55 is divided from a power supply voltage $E_H$ by using two resistors 56 and 57 connected to the voltage stabilizing circuit 53 and having resistance values r1 and r2 respectively. Therefore, Vref= $\{r2/(r1+r2)\}$ $E_H$. The reference voltage Vref defined in this way has a merit that no measurement error is caused even when the power supply voltage $E_H$ fluctuates. The resistance values r1 and r2 are defined so as to set the reference voltage Vref, for example, equal to ½ $E_H$. A reference resistor 60 and a transistor 61 are connected in parallel to the resistors 49*a* to 49*n* and transistors 48*a* to 48*n*. The reference resistor 60 has a known resistance value Rs whose tolerance is about 1%.

Now, the operation of the embodiment as set forth above will be described.

Figure 6:
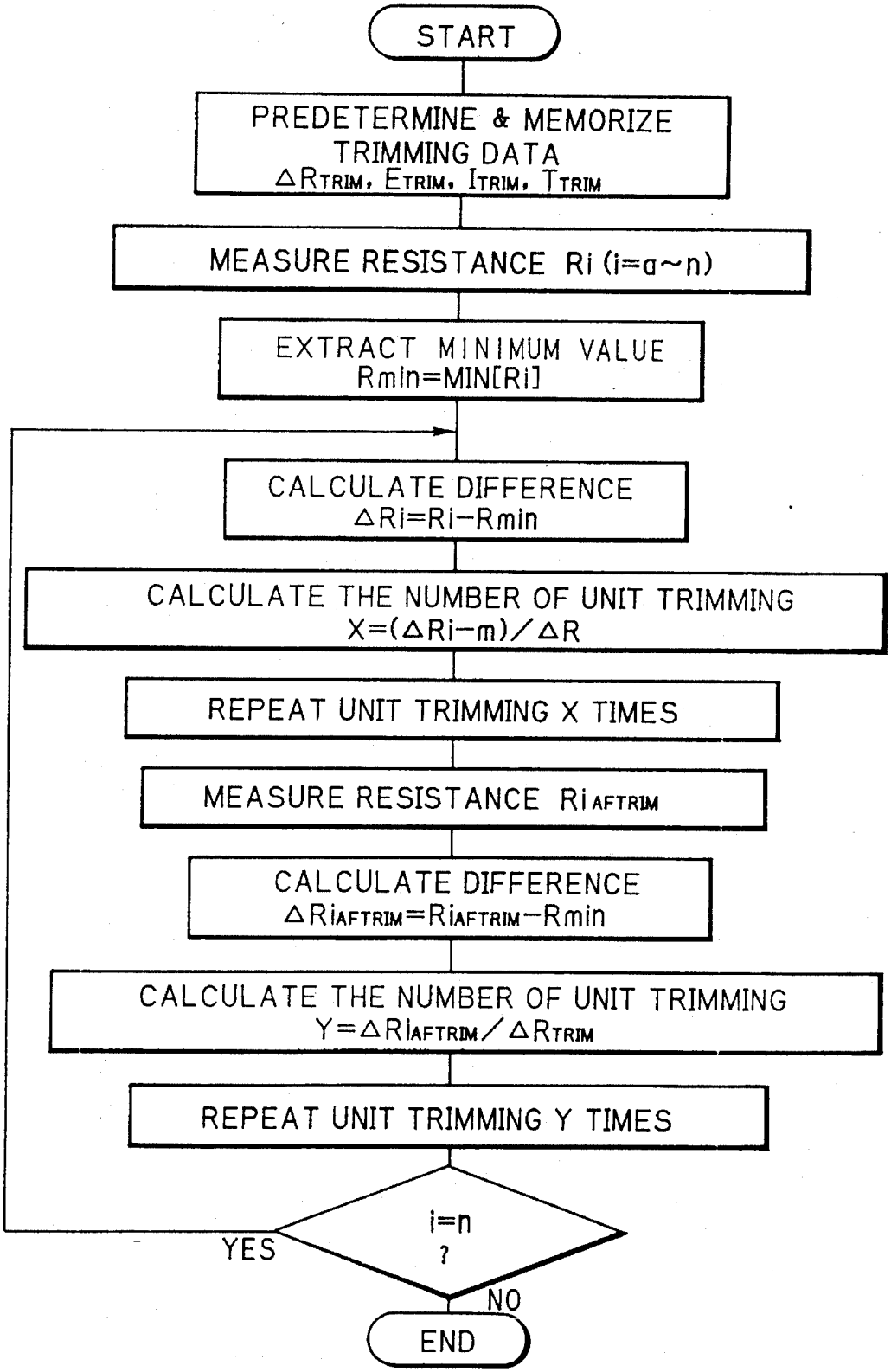
FIG. 6 is a flow chart of the resistance trimming process for the heating elements according to a preferred embodiment of the present invention.
Figure 7:
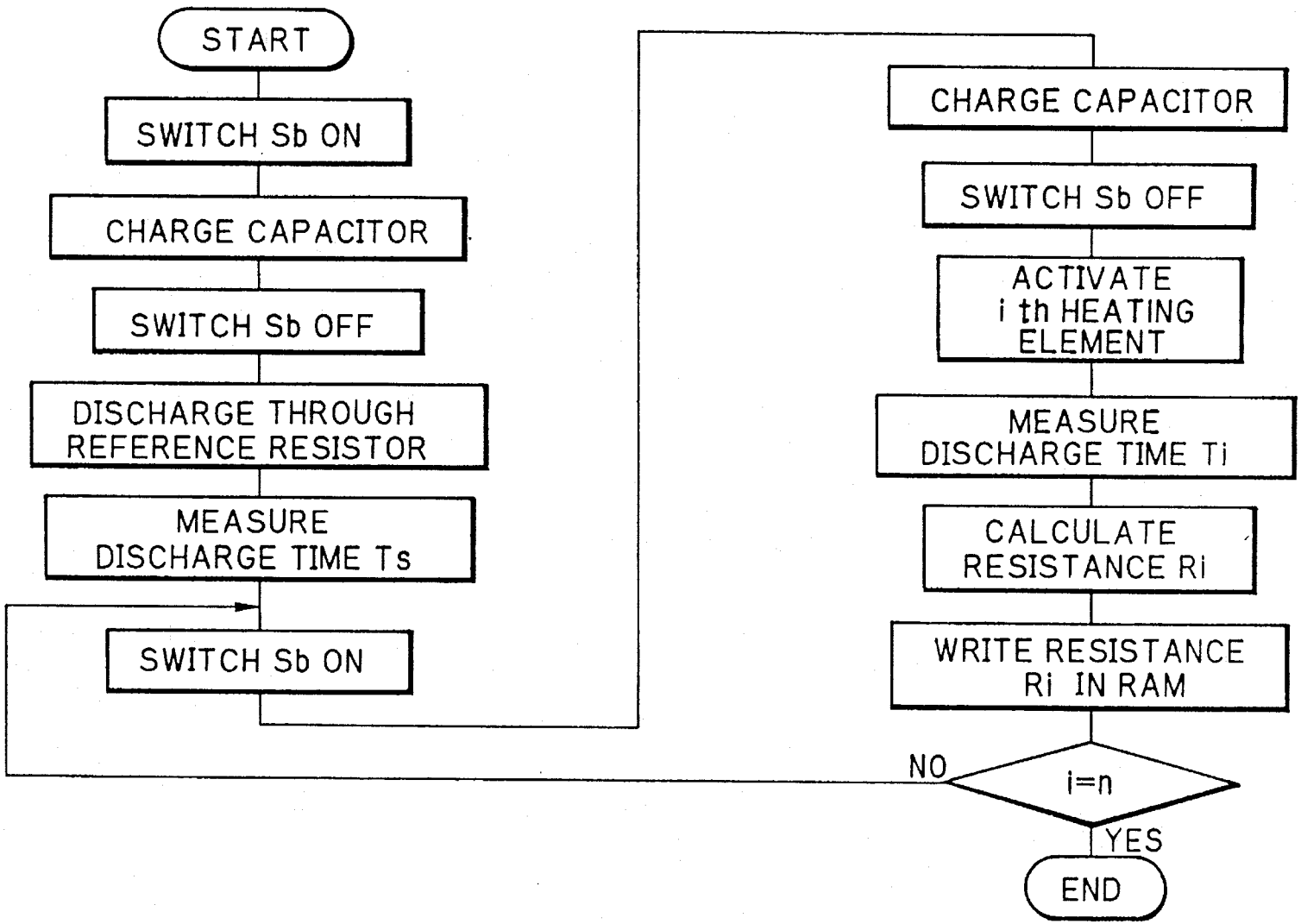
FIG. 7 is a flow chart of the resistance measuring mode of the direct thermal printer shown in FIG. 5.

The resistance trimming process is executed during the initial setup operation. As illustrated in FIG. 6, the thermal printer is switched to the resistance measuring mode through the first switch Sa by connecting the shift register 44 to the microcomputer 43. In the resistance measuring mode, the microcomputer 43 first outputs such control data that turns the transistor 61 ON and other transistors 48*a* to 48*n* OFF. Then, a resistance measuring section 43*a* of the microcomputer 43 turns the second switch Sb ON so as to start charging the capacitor 50, as illustrated in FIG. 7. After the capacitor 50 is fully charged and thus the charge voltage $V_H$ of the capacitor 50 reaches the value $E_H$, the second switch Sb is turned OFF to discharge the capacitor 50 through the reference resistor 60. Discharge time Ts through the reference resistor 60 is measured from the start of discharging to a time when the voltage level $V_H$ at the non-inverting input of the comparator 55, that is, the charge voltage of the capacitor 50, decreases down to a level equal to the reference voltage Vref.

Next, to measure the resistance value Ra of the resistor 49*a* corresponding to the first heating element 21, the transistor 48*a* alone is turned ON while other transistors 48*b* to 48*n* and 61 are maintained OFF. The second switch Sb is turned ON to charge the capacitor 50, and thereafter, turned OFF so as to measure a discharge time Ta through the resistor 49*a*. Based on the discharge times Ts and Ta , a resistance value Ra of the resistor 49*a* is detected. Resistance value Ri of i-th resistor 49*i* (i=a to n, n=an integer) is calculated according to the following equation:

$$Ri=(Ti/Ts)Rs \quad (1)$$

Because the tolerance of the resistance Rs of the reference resistor 60 is about 1%, the resistance value Ri can be calculated at a high accuracy. The detected resistance value Ra is stored in a RAM 43*b* which is incorporated in the microcomputer 43. Resistance values Rb to Rn of the second and following resistors 49*b* to 49*n* constituting the heating elements 21 are measured and stored in the RAM 43*b* in the same way as for the first resistor 49*a*. A backup battery 62 is incorporated in the microcomputer 43, for supplying power to the RAM 43*b* even when the power supply voltage $E_H$ breaks down.

Next, a minimum value Rmin is extracted from among the resistance values Ra to Rn stored in the RAM 43*a*, and a difference of each one of the resistance values Ra to Rn from the minimum value Rmin is calculated. Based on the difference, it is determined how many times the unit trimming should be repeated for each heating element.

For example, the number of times X of the unit trimming to be executed in a main trimming process for the i-th heating element 21 or the resistor 49*i* is calculated according to the following equation:

$$X=(\Delta Ri-M)/\hat{}R_{TRIM} \quad (2)$$

wherein M is a correction value which is several times, e.g. three times, as much as the unit resistance reduction $\hat{}R_{TRIM}$.

Then, the unit trimming is repeated X times. For each unit trimming, the first switch Sa still connects the shift register 44 to the microcomputer 43, and the microcomputer 43 outputs the voltage change signal to the voltage stabilizing circuit 53 through the D/A converter 54, so as to set the power supply voltage to the unit trimming voltage $E_{TRIM}$ which is different from or higher than the voltage level for the printing. Thereafter, the unit trimming current $I_{TRIM}$ is conducted through the i-th resistor 49*i* for the unit trimming time $T_{TRIM}$. In theory, the resistance of the resistor 49*i* is reduced by the unit resistance reduction $\Delta R_{TRIM}$ as the result of one unit trimming. After repeating X times of unit trimming and thus trimming the resistance of the i-th resistor 49i, a resistance value $Ri_{AFTRIM}$ of the i-th resistor 49*i* is measured in the same way as above, so as to detect a difference $\hat{}Ri_{AFTRIM}$ between the resistance value $Ri_{AFTRIM}$ and the minimum resistance value Rmin. Based on the difference $\hat{}Ri_{AFTRIM}$, the number Y of times of the unit trimming to be repeated for a sub-trimming process is determined according to the following equation:

$$Y=\Delta Ri_{AFTRIM}/\Delta R_{TRIM} \quad (3)$$

The sub-trimming process is provided for fine adjustment of the resistance value of each individual heating element, and no correction value such as N necessary for the main trimming process is utilized in calculating the number Y of times. In this way, the resistance of the heating element 21 is reduced or trimmed once in the main trimming process to a value close to the minimum resistance value Rmin, and twice, in the sub-trimming process to a value closer to the minimum resistance value Rmin. This is because there are variances not only in resistance but also in width and thickness of the heating elements 21, so that the resistance could be over trimmed to be less than the minimum resistance value Rmin if the unit trimming would be repeated the number of times that is determined by dividing the difference ΔRi by the unit resistance reduction $\Delta R_{TRIM}$. By measuring and trimming the resistance in two steps, the resistance of each heating element is reduced to be approximately equal to the minimum resistance value Rmin, without over trimming. Therefore, the resistance trimming or equalizing can be accomplished at a high precision.

The resistance trimming is performed in this way for necessary ones of the heating elements 21, and thus the resistances Ra to Rn of all the heating elements 21 are substantially -equalized. Thereafter, the thermal printer can be switched to a print mode, wherein there is no need for correcting image data or drive pulses in accordance with resistance unevenness of the heating elements 21.

It is to be noted that the sub-trimming process may be executed after completion of the main trimming process for all the necessary heating elements 21, instead of being executed for each heating element right after the main trimming process of the same heating element. It is also possible to apply the trimming energy continuously, instead of applying the trimming energy intermittently in the form of pulses each corresponding to the constant amount of trimming energy.

To set the print mode, the first switch Sa is switched over to connect the shift resistor 44 to the comparator 42. In the print mode, the image data of a frame of full color image is written first in the frame memory 40 separately for each color.

During paper feeding, the platen drum 10 stays in a situation where the clamp member 12 is placed at the exit of the paper passageway 27 with its arm portions oriented vertically in FIG. 1. When the solenoid 18 is energized, the clamp member 12 is set to a clamp release position where the clamp portion thereof is removed off the platen drum 10. The pair of feed rollers 28 nip and feed the thermosensitive color recording paper 11 toward the platen drum 10. The feed rollers 28 stop rotating when the leading end of the thermosensitive color recording paper 11 is placed between the platen drum 10 and the clamp member 12. Thereafter when the solenoid 18 is turned OFF, the clamp member 12 is returned to the initial position according to the act of the spring 17, thereby clamping the leading end 11*a* of the thermosensitive color recording paper 11. After clamping the thermosensitive color recording paper 11, the platen drum 10 and the feed rollers 28 start rotating, so that the thermosensitive color recording paper 11 is wound on the outer periphery of the platen drum 10.

The platen drum 10 is rotated intermittently by a predetermined step. When a leading edge of a recording area of the thermosensitive color recording paper 11 reaches the thermal head 20, first the recording of a yellow frame of the full-color image is started. During the yellow frame recording, the image data of one line of the yellow frame are read out from the frame memory 40, and are temporarily written in the line memory 41.

Then, the image data are read out from the line memory 41, and are sent to the comparator 42 wherein the image data is compared with the first gradation data of the lowest density "0". The comparator 42 outputs a high level signal "H" for a pixel to be recorded as a yellow dot, and outputs a signal "L" for such a pixel to have no yellow dot. The results of these comparisons are sent to the shift register 44 in the form of serial drive data. The serial drive data is shifted by the clock in the shift register 44 so as to be converted into parallel drive data. The parallel drive data is latched in the latch array 45 and then sent to the AND gate array 46.

At that time, the microcomputer 43 outputs a bias heating pulse having a relatively large width as a first strobe signal to the AND gate array 46. Because the AND gate array 46 outputs logical products of the strobe signal and the respective output signals of the latch array 45, a high level signal "H" appears on those outputs of the AND gate array 46 which correspond to the outputs of the latch array 45 having the high level signals "H". For example, if the first output of the AND gate array 46 takes the high level, the first transistor 48*a* is turned ON, so that the first resistor 49*a* is activated or power is conducted for a time period corresponding to the width of the bias heating pulse. As a result, a predetermined amount of bias heat energy is applied to the thermosensitive color recording paper 11.

Before the end of the bias heating, the microcomputer 43 outputs the gradation data "1" as the reference data for the second tonal step "1" to the comparator 42. The image data of each pixel is compared with the gradation data "1". As a result of this comparison, a serial drive data is produced and written in the shift register 44. When the bias heating is complete, the microcomputer 43 generates a gradation pulse having a width less than that of the bias heating pulse. The gradation pulse is applied as a subsequent strobe signal to the AND gate array 46. In response to this strobe pulse, some of the resistors 49*a* to 49*n* are activated in accordance with the drive data for a shorter time corresponding to the width of the gradation pulse, thereby to develop color on the yellow recording layer Ly at a density corresponding to the tonal step "1".

Thereafter, a similar process is repeatedly carried out for recording the first line of the yellow frame on the yellow recording layer Ly until the microcomputer 43 has generated the last gradation data "3F" corresponding to the maximum density. Therefore, the resistors 49*a* to 49*n* are selectively driven in accordance with the corrected image data for the first line of the yellow frame, while a single bias heating pulse and, thereafter, 1 to 64 gradation pulses are applied to as the strobe signals. For example, for recording a pixel of the maximum density, 64 pulse currents are conducted through the corresponding resistor. In this way, a line of pixels having 64 tonal steps are recorded.

After the recording of the first line of the yellow frame is complete, the platen drum 10 is rotated by an amount corresponding to one pixel. Simultaneously, the image data of the second line of the yellow frame are read out from the frame memory 40. Thereafter, the same procedure as above is repeated for recording the second and the following lines of the yellow frame. When the part of the recording paper 11 on which the yellow frame is recorded is moved under the optical fixing device 22, the optical fixing device 22 starts optical fixing of the yellow recording layer Ly.

When the platen drum 10 makes one revolution to place the leading edge of the recording area again under the thermal head 20, a magenta frame of the full-color image begins to be recorded line by line. Although the heat energy applied for coloring the magenta recording layer Lm is larger than the heat energy for coloring the yellow recording layer Ly, the yellow recording layer Ly is not colored because the yellow recording layer Ly has already been optically fixed. The magenta recording layer Lm having the magenta frame recorded therein is optically fixed by means of the optical fixing device 23.

When the platen drum 10 further makes one revolution so as to place the recording area under the thermal head once again, recording of a cyan frame of the full-color image begins line by line in the cyan recording layer Lc. Because the heat energy necessary for coloring the cyan recording layer Lc has such a large value that cannot be applied to the recording paper 11 under a normal keeping condition, the cyan recording layer Lc is not given a capacity of being optically fixed. For this reason, the optical fixing devices 22 and 23 are turned OFF in the cyan frame recording.

After recording the yellow, magenta and cyan frames of the full-color imaging, the platen drum 10 and the feed rollers 28 are rotated reversely. Thereby, the trailing end of the recording paper 11 is guided by the separation claw 29 into the paper passageway 27, and is nipped by the feed rollers 28. Thereafter when the platen drum 10 reaches the initial position at which the clamp member 12 is placed at the exit of the paper passageway 27,the solenoid 18 is turned on, and simultaneously the platen drum 10 stops rotating. When the solenoid 18 is turned on, the clamp member 12 is moved to the clamp release position against the act of the spring 17, so that the leading end of the recording paper 11 is released from the clamp member 12, and is ejected from the platen drum 10 through the paper passageway 27.

While the present invention has been described with respect to a direct color thermal printer embodying the present invention, it is possible to provide a separate resistance equalizing device for equalizing resistances of the heating elements. It is also possible to incorporate a resistance equalizing device into a resistance measuring device for measuring resistance of heating elements, as a unit separate from the thermal printer. However, incorporating such a resistance measuring and trimming function into the thermal printer makes it possible to equalize the resistances of heating elements at ease after the thermal head is replaced by a new one.

It is to be noted that the resistance measuring should not be limited to the above-described embodiment. Furthermore, it is also possible to apply trimming energy to heat the heating element to an extent that increases the resistance of the heating element, so as to equalize the resistances of the heating elements with reference to the maximum resistance value.

Although the above described embodiment only relates to a line printer wherein a plurality of heating elements 21 are arranged in the main scan direction, and the recording paper 11 is moved linearly relative to the thermal head 20 in the subsidiary scan direction, the present invention is applicable to serial printers wherein pixels are serially printed by a two-dimensional movement of the recording paper 11 relative to the thermal head 20.

Of course, the present invention is applicable not only to the direct color thermal printer as described so far, but also to monochromatic thermal printers or other type thermal printers, such as thermal wax transfer and thermal dye transfer or a sublimation-type thermal transfer recording type printer.

While the present invention has been described with reference to the embodiment shown in the drawings, the invention should not be limited by the embodiment but, on the contrary, various modifications of the present invention can be effected without departing from the spirit and scope of the appended claims.

What is claimed is:

1. A method of equalizing resistances of heating elements of a thermal head which are arranged in an array, said method comprising the steps of:

(A) measuring respective resistance values of said heating elements;

(B) extracting and determining a smallest resistance value from among said resistance values of said heating elements;

(C) detecting a difference between said smallest resistance value and a larger value of said resistance values; and (D) applying a trimming energy of an amount variable in accordance with said difference to a first one of said heating elements which has said larger value so as to trim a resistance for said first one of said heating elements.

2. The method as recited in claim 1, wherein said trimming energy is obtained by applying a first voltage, which is higher than a print voltage for driving said heating elements in printing and is variable depending on said difference, for a constant time, or by applying a second voltage which is constant and higher than said print voltage for a time variable depending on said difference.

3. The method as recited in claim 2, further comprising measuring the resistance for said first one of said heating elements again at a mid time of application of said trimming energy, and thereafter, repeating said steps (C) and (D) on the basis of the resistance measured at said mid time for said first one of said heating elements.

4. A method of equalizing resistances of heating elements of a thermal head which are arranged in an array, said method comprising the steps of:

(A) measuring respective resistance values of said heating elements;

(B) extracting and determining a smallest resistance value from among said resistance values of said heating elements;

(C) detecting a difference between said smallest resistance value and a larger value of said resistance values;

(D) dividing said difference by a predetermined constant resistance reduction value to determine a number of times a constant amount of a trimming energy should be applied to a first one of said heating elements which has said larger value, wherein said predetermined constant resistance reduction value represents an amount of resistance reduction obtained by applying said constant amount of said trimming energy; and (E) applying said constant amount of said trimming energy to said first one of said heating elements for said number of times determined in said step (D), thereby heating said first one of said heating elements and reducing a resistance of said first one of said heating elements to be within a predetermined amount of said smallest resistance value.

5. The method as recited in claim 4, wherein said constant amount of said trimming energy represents an electric energy obtained by applying a constant voltage for a constant time, said constant voltage being higher than a print voltage used for driving said heating elements in printing.

6. A method of equalizing resistances of heating elements of a thermal head which are arranged in an array, said method comprising the steps of:

(A) measuring respective resistance values of said heating elements;

(B) extracting and determining a smallest resistance value from among said resistance values of said heating elements;

(C) detecting a difference between said smallest resistance value and a larger value of said resistance values;

(D) calculating a number of application repetitions for a constant amount of a trimming energy to a first one of said heating elements which has said larger value, according to the following equation:

$$X=(\Delta Ri-M)/\Delta R_{TRIM};$$

in which X is said number of application repetitions of said constant amount of said trimming energy, said constant amount of said trimming energy reducing said resistance values of said heating elements by a constant resistance reduction value, $^{\Delta}$ Ri is said difference between said larger value and said smallest resistance value, $\Delta R_{TRIM}$ is said constant resistance reduction value, and M is a predetermined value which is a predetermined number of times greater than said constant resistance reduction value;

(E) applying said constant amount of said trimming energy to said first one of said heating elements for a first predetermined number of times;

(F) measuring a reduced resistance value of said first one of said heating elements;

(G) detecting a new difference between said reduced resistance value and said smallest resistance value; and (H) applying said constant amount of said trimming energy again to said first one of said heating elements for a second predetermined number of times, wherein said second predetermined number of times is determined according to the following equation:

$$Y=\Delta Ri_{AFTRIM}/\Delta R_{TRIM}$$

in which Y is said second predetermined number of times, and $\Delta Ri_{AFTRIM}$ is said new difference between said reduced resistance value and said smallest resistance value.

7. The method as recited in claim 6, wherein said resistance measuring step (A) comprises the steps of:

(A)(1) charging a capacitor up to a first voltage level with said capacitor being connected in parallel to said heating elements;

(A)(2) discharging said capacitor through a reference resistor of a known resistance which is connected in parallel to said heating elements;

(A)(3) measuring a first discharge time required to discharge said capacitor through said reference resistor from said first voltage level to a second voltage level;

(A)(4) turning one of said heating elements ON, so as to discharge said capacitor through said one of said heating elements whose resistance is to be measured;

(A)(5) measuring a second discharge time required to discharge said capacitor through said one of said heating elements from said first voltage level to said second voltage level;

(A)(6) calculating a resistance value of said one of said heating elements on the basis of said measured said first and second discharge times; and (A)(7) storing said resistance value in a memory.

8. An apparatus for equalizing resistances of heating elements of a thermal head which are arranged in an array, said apparatus comprising:

memory means for storing unit trimming data including a constant resistance reduction value and a constant amount of a trimming energy for reducing resistances of heating elements by said constant resistance reduction value;

measuring means for measuring respective resistance values of said heating elements;

extracting means, receiving said resistance values from said measuring means, for extracting and determining a smallest resistance value from among said resistance values of said heating elements;

detecting means, receiving said smallest resistance value from said extracting means, for detecting a difference between said smallest resistance value and a larger value of said resistance values;

determining means, receiving said difference from said detecting means and said unit trimming data from said memory means, for determining, with reference to said unit trimming data and depending on said difference, a number of times said constant amount of said trimming energy should be applied to a first one of said heating elements which has said larger value; and applying means, receiving said number of times from said determining means, for applying said constant amount of said trimming energy to said first one of said heating elements for said number of times determined by said determining means.

9. The apparatus as recited in claim 8, wherein said applying means comprises:

power supply means for supplying said trimming energy to said heating elements;

an array of switches each for connecting and disconnecting one of said heating elements to said power supply means; and controlling means, receiving said number of times from said determining means, for controlling said array of switches to selectively supply said heating elements with said constant amount of said trimming energy.

10. The apparatus as recited in claim 9, wherein said constant amount of said trimming energy represent an electric energy obtained by applying a constant voltage for a constant time, said constant voltage being higher than a print voltage used for driving said heating elements in printing.

11. The apparatus as recited in claim 8, wherein said power supply means is switched to output either said voltage for said trimming energy or said print voltage.

12. A thermal printer having a thermal head whose heating elements are arranged in an array, said thermal printer comprising:

memory means for storing unit trimming data including a constant resistance reduction value and a constant amount of a trimming energy for reducing resistances of heating elements by said constant resistance reduction value;

measuring means for measuring respective resistance values of said heating elements;

extracting means, receiving said resistance values from said measuring means, for extracting and determining a smallest resistance value from among said resistance values of said heating elements;

detecting means, receiving said smallest resistance value from said extracting means, for detecting a difference between said smallest resistance value and a larger value of said resistance values;

determining means, receiving said difference from said detecting means and said unit trimming data from said memory means, for determining, with reference to said unit trimming data and depending on said difference, a number of times said constant amount of said trimming energy should be applied to a first one of said heating elements which has said larger value;

power supply means for supplying said trimming energy to said heating elements;

an array of switches each for connecting and disconnecting each of said heating elements to said power supply means; and controlling means, receiving said number of times from said determining means, for controlling said array of switches to selectively supply said heating elements with said constant amount of said trimming energy for said number of times that is determined by said determining means.

13. The thermal printer as recited in claim 12, wherein said constant amount of said trimming energy represents an electric energy obtained by applying a constant voltage for a constant time, said constant voltage being higher than a print voltage used for driving said heating elements in printing.

14. The thermal printer as recited in claim 13, wherein said power supply means is switched to output either said voltage for said trimming energy or said print voltage.

15. A method of equalizing resistances of heating elements of a thermal head of a thermal printer which are arranged in an array, said method comprising the steps of:

(A) measuring respective resistance values of said heating elements;

(B) extracting and determining a largest resistance value from among said resistance values of said heating elements;

(C) detecting a difference between said largest resistance value and a smaller value of said resistance values;

(D) determining a resistance trimming value depending on said difference with respect to a resistance increase amount which is experimentally detected by applying a predetermined amount of an electric energy to a test heating element having a construction equivalent to a construction of said heating elements; and (E) applying a variable amount of said electric energy in accordance with said resistance trimming value, to a first one of said heating elements which has said smaller value, so as to heat said first one of said heating elements and increase a resistance of said first one of said heating elements to be within a predetermined amount of said largest resistance value.

* * * * *